US008204411B2

(12) United States Patent
Stelter et al.

(10) Patent No.: US 8,204,411 B2
(45) Date of Patent: Jun. 19, 2012

(54) ELECTROGRAPHIC IMAGE DEVELOPING APPARATUS AND METHOD FOR DEVELOPING INCLUDING COMPENSATION FOR SLIPPAGE

(75) Inventors: Eric C. Stelter, Pittsford, NY (US); Joseph E. Guth, Holley, NY (US)

(73) Assignee: Eastman Kodak Company, Rochester, NY (US)

( * ) Notice: Subject to any disclaimer, the term of this patent is extended or adjusted under 35 U.S.C. 154(b) by 374 days.

(21) Appl. No.: 12/533,044

(22) Filed: Jul. 31, 2009

(65) Prior Publication Data

US 2011/0026976 A1 Feb. 3, 2011

(51) Int. Cl.
*G03G 15/09* (2006.01)

(52) U.S. Cl. ..... 399/267; 399/277

(58) Field of Classification Search ..... 399/267, 399/276, 277

See application file for complete search history.

(56) References Cited

U.S. PATENT DOCUMENTS

| | | | | |
|---|---|---|---|---|
| 4,473,029 | A | 9/1984 | Fritz et al. | |
| 4,546,060 | A | 10/1985 | Miskinis et al. | |
| 4,559,899 | A | 12/1985 | Kan et al. | |
| 4,804,994 | A | 2/1989 | Sasaki et al. | |
| 5,489,975 | A | 2/1996 | Kaukeinen et al. | |
| 5,930,554 | A | 7/1999 | Godlove | |
| 6,219,513 | B1 * | 4/2001 | Ikeda | 399/267 |
| 6,512,908 | B2 * | 1/2003 | Mitamura | 399/267 |
| 6,526,247 | B2 * | 2/2003 | Stelter et al. | 399/276 |
| 6,723,481 | B2 | 4/2004 | Lambert et al. | |
| 6,728,503 | B2 | 4/2004 | Stelter et al. | |
| 6,959,162 | B2 | 10/2005 | Stelter | |
| 7,379,693 | B2 * | 5/2008 | Ogawa et al. | 399/277 |
| 2002/0025487 | A1 | 2/2002 | Lambert et al. | |
| 2004/0247345 | A1 | 12/2004 | Stelter et al. | |

OTHER PUBLICATIONS

U.S. Appl. No. 12/342,138, filed Dec. 23, 2008, Xiqiang.

H. Harada, K. Yamashita: "Application of Magnet to Copy Machine", Journal of the Magnetic Society of Japan, vol. 4, No. 4, (1980), Nov. 30, 1980, pp. 136-141, XP002607378, ISSN: 0285-0192, Figure 9; Table 1.

* cited by examiner

*Primary Examiner* — William J Royer
(74) *Attorney, Agent, or Firm* — Donna P. Suchy

(57) ABSTRACT

An electrostatic printing method in which the toning shell and the magnetic core each rotate in a co-current direction with the imaging member such that the portion of the toning shell adjacent to the image development area moves in a process direction, and the magnetic core rotates in the same direction as the toning shell such that a the average developer bulk velocity (ADBV) of the developer on the toning shell is in the same direction and proportional to the photoconductor velocity.

19 Claims, 8 Drawing Sheets

ELECTROGRAPHIC IMAGE DEVELOPING APPARATUS AND METHOD FOR DEVELOPING INCLUDING COMPENSATION FOR SLIPPAGE

FIELD OF THE INVENTION

The invention relates to electrographic image development, and more particularly to an apparatus and method for developing an electrostatic image using dry powder deposition including compensation for slippage.

BACKGROUND OF THE INVENTION

Processes for developing electrographic images with a magnetic brush using dry toner are well known in the art and are used in many electrographic printers and copiers. One electrographic printer technology employs a photoconductive imaging member to which a uniform electrostatic charge is applied. The imaging member is selectively exposed to light to produce an electrostatic image on the photoconductive imaging member.

Electrographic printers frequently employ a dry powder process for developing an electrographic image that utilizes a developer having at least two components including magnetic carrier particles and toner particles. The electrostatically-charged toner particles are pigmented for producing the final image, while the carrier particles are magnetic particles that allow delivery of the toner using electric and magnetic fields. In an example process, the developer is deposited on an electrically biased rotating toning shell. The toning shell rotates the developer into proximity with an imaging member that is moving in a process direction. At a location where the imaging member and the toning shell are in closest proximity, referred to as the "toning nip", the toner is transferred onto the electrostatic image on the imaging member to form a toner image. In the toning nip, the magnetic carrier component of the developer forms a "nap" consisting of chains of developer particles rising from the surface of the toning shell under the influence of a magnetic field applied in the toning nip. The nap height is maximal when the magnetic field from either a north or south pole is perpendicular to the toning shell. A magnetic core having magnetic poles directed towards an interior surface of the toning shell and rotating relative to the toning shell can be used to generate the magnetic field outside the toning shell and in the toning nip. Typically, adjacent magnetic poles in the magnetic core have opposite polarity and, accordingly, as the magnetic core rotates, the magnetic field also rotates so that the magnetic field at the surface of the toning shell rotates from a direction perpendicular to the toning shell to parallel to the toning shell.

As the magnetic core rotates, the magnetic carrier chains appear to flip end over end and walk on the surface of the toning shell. The direction of rotation of the carrier chains is opposite in sense to the direction of rotation of the magnetic core. If the magnetic core rotates clockwise, the magnetic field at the surface of the toning shell and the carrier chains rotate counterclockwise. The agitation of the carrier chains provides energy to free the toner particles to interact with the electrostatic field of the imaging member.

SUMMARY OF THE INVENTION

This invention is directed to an electrostatic printing method in which a toning shell and a magnetic core each rotate in a co-current direction with the imaging member such that the portion of the toning shell adjacent to an image development area moves in a process direction, and the magnetic core rotates in the same direction as the toning shell such that a an average developer bulk velocity (ADBV) of a developer on the toning shell is in the same direction and proportional to a photoconductor velocity. The invention is also directed to apparatus for producing an image using the inventive method, including compensation for slippage of developer on the toning shell. A variety of developers can be employed using the inventive method. An exemplary method comprises moving the imaging member in a process direction, moving the toning shell with a co-direction velocity through a toning nip formed between the imaging member and the toning shell, and providing a rotating magnetic core inside the toning shell rotating in the same direction as the toning shell where a magnetic field vector at a portion on the toning shell rotates in the opposite sense as the toning shell.

The invention, and its objects and advantages, will become more apparent in the detailed description of the preferred embodiment presented below.

DETAILED DESCRIPTION OF THE INVENTION

Figure 1:
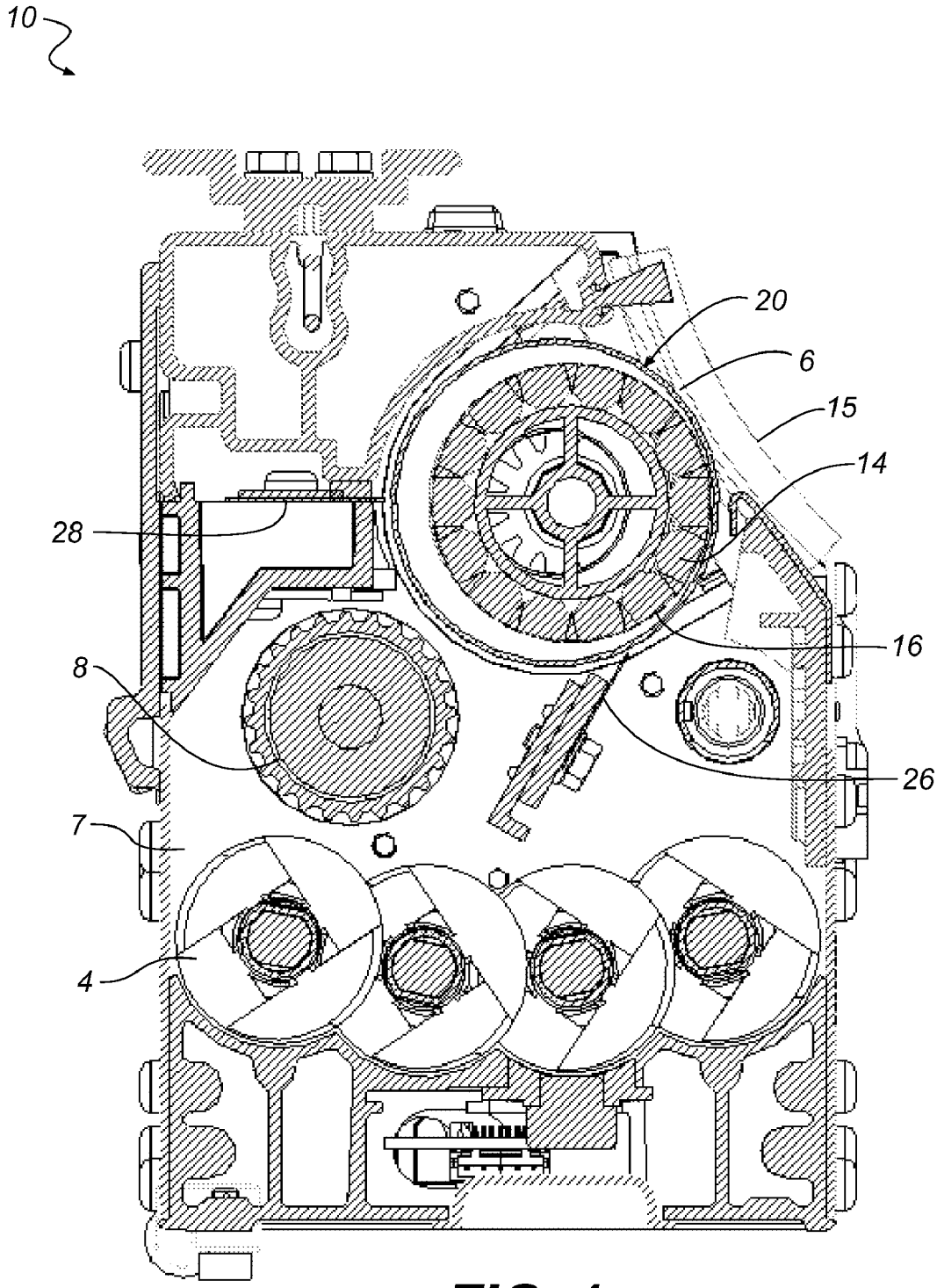
FIG. 1 presents a side view of an apparatus for developing electrographic images, according to the present invention.
Figure 2:
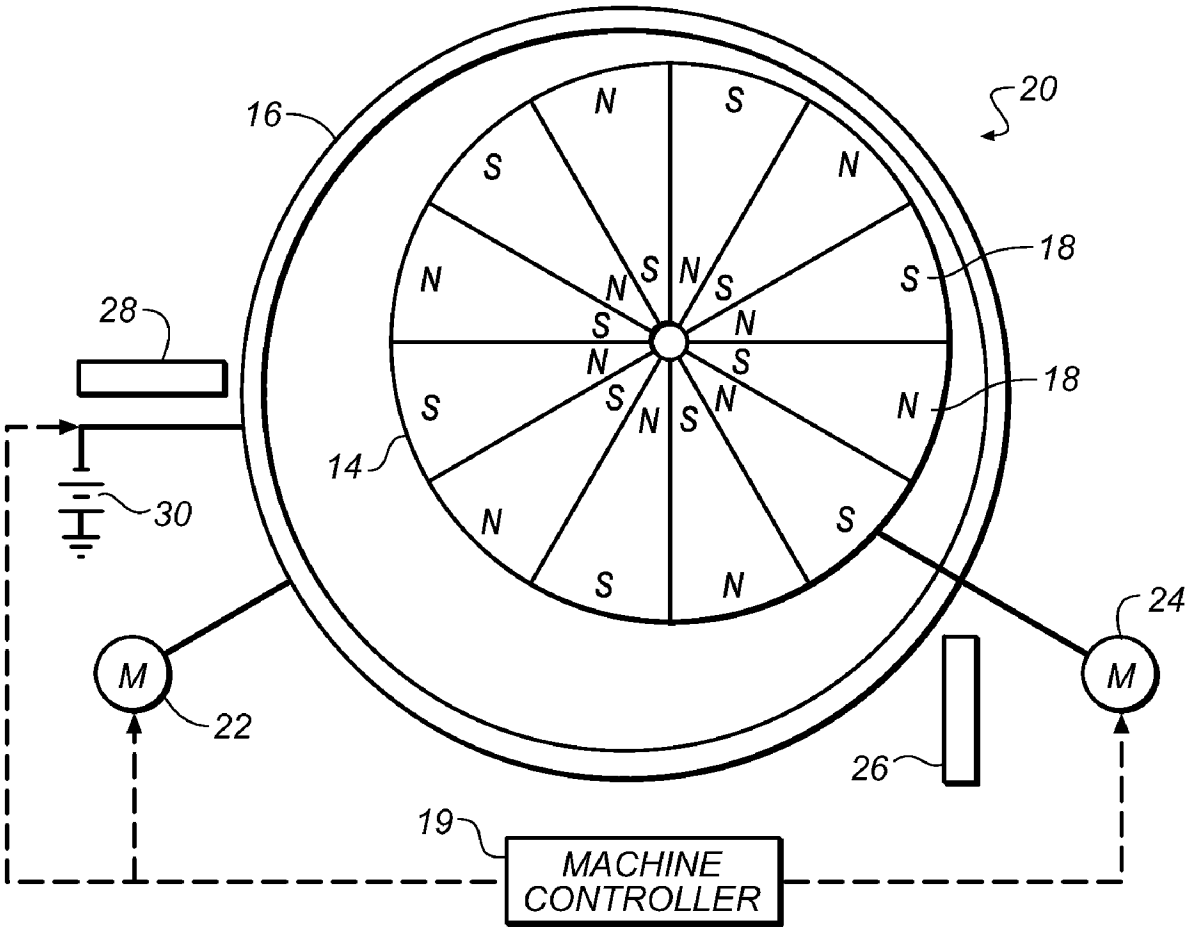
FIG. 2 is a block diagram schematically illustrating magnetic brush components of an image developing apparatus of FIG. 1.

FIGS. 1 and 2 depict an exemplary electrographic printing apparatus 10 in accordance with an embodiment of the invention. The apparatus 10 for developing electrographic images includes an electrographic imaging member 15 on which an electrostatic image is formed, and a magnetic brush 20 that delivers developer to the imaging member 15 to form a developed image. The magnetic brush 20 includes a toning shell 16, and a magnetic core 14 located inside the toning shell 16. The magnetic core 14 includes a plurality of magnets having their magnetic poles 18 arranged so that adjacent magnetic poles 18 of the magnetic core 14 present poles of opposite polarity towards the interior surface, and likewise towards the exterior surface, of the toning shell 16. The magnetic core in one embodiment is positioned, relative to the shell, such that a magnetic center of the magnetic core is located relative to the toning shells center. The magnetic core 14 in this position relative to the toning shell 16 is also referred to as an eccentric core, and the magnetic core 14 can rotate relative to the toning shell 16 as is described in more detail below and shown in FIG. 2.

The imaging member 15 is illustrated as a drum, and is made of a material capable of retaining an electrostatic image. Alternatively, the imaging member 15 may have configurations other than a drum. For example the imaging member 15 may be a sheet like film for receiving an image. When configured as a film, the imaging member 15 is relatively resilient and is held in a desired position relative to the toning shell 16. In a photoconductive process, the imaging member 15 is initially charged to a uniform imaging potential. The uniform electrostatic charge on the imaging member 15 is then discharged by performing an image-wise exposure of the imaging member 15 to form the electrostatic image.

The imaging member 15 and the toning shell 16 form an area therebetween known as a toning nip 6. Developer is delivered to the toning shell 16 upstream (relative to the process direction) of the toning nip 6 using a metering skive 28.

When the developer is delivered to the toning shell 16, initially, an average velocity of the developer at a delivery point is greater than that of the developer on other parts of the toning shell 16. As a result, compressed developer builds up immediately upstream of the toning nip 6 creating a roll back zone. The imaging member 15 rotates so that the surface of the imaging member 15 moves in a process direction through the toning nip 6.

The toning shell 16 is provided with a driver for rotating the toning shell 16 so that the outer surface of the toning shell 16 moves through the toning nip 6. In FIG. 2, the driver is shown as motor 22. The magnetic core 14 is provided with a means such as motor 24 which is a magnetic field driver for rotating the magnetic core 14 within the toning shell 16. As the toning shell 16 and the magnetic core 14 are provided with separate rotation means, the respective directions and speeds of rotation of the magnetic core 14 and the toning shell 16 may be set independently. As the magnetic core 14 is rotated, the alternating poles 18 of the magnetic core 14 produce magnetic pole transitions at the developer on the toning shell 16.

Although described in terms of a rotating magnetic core 14 with multiple poles 18, the invention can be practiced with any arrangement that subjects the carrier particles of the developer to a magnetic field vector that rotates in space. In an alternative arrangement, the magnetic core 14 can comprise an array of fixed magnets and the magnetic field generated by the magnetic core 14 is modulated or varied by a suitable source to produce magnetic pole transitions of alternating maxima in the developer. A magnetic core 14 with individually rotating magnetic poles 18 can be used. These means of changing the magnetic field establish a speed and direction of rotation for the magnetic field of the magnetic core 14.

The magnetic brush 20 operates according to principles described in U.S. Pat. Nos. 6,959,162, 4,473,029 and 4,546,060, the contents of which are fully incorporated by reference as if set forth herein. The developer preferably is a two component developer including carrier particles and pigmented toning particles. The carrier particles comprise a magnetic material exhibiting hard magnetic properties The direction of rotation of the toning shell 16 is said to be co-current with the imaging member 15 when the surface of the toning shell 16 moves through the toning nip 6 in the same direction as the imaging member 15. In FIG. 1, the imaging member 15 is a drum rotating in a counterclockwise direction, and accordingly, when the toning shell 16 rotates in a clockwise direction, the surface of the toning shell basses through the toning nip 6 in the same direction as the imaging member 15. In one embodiment the surface speed of the toning shell 16 is greater than a surface speed of the imaging member 15, also known as the photoconductor in the developed area. Accordingly, for the illustrated arrangement, a clockwise rotation of the toning shell 16 is co-current rotation, and counterclockwise rotation of the toning shell 16 is counter-current rotation. Rotation for the magnetic core 14 is expressed using the same convention. That is, given a counterclockwise rotation of imaging member 15 a clockwise rotation of the magnetic core 14 is co-current rotation while a counterclockwise rotation of the magnetic core 14 is counter-current rotation.

The speed of rotation of the magnetic core 14, the geometry of the toning nip 6, and the process speed of the imaging member 15 determine the number of pole transitions that are applied to the toner in the toning nip 6. For a magnetic core 14 having alternating poles 18 rotating at 1100 RPM, the magnetic field transitions from N to S about 257 times per second (14*1100/60) as measured in the frame of reference of a stationary observer. For a 17.49 inches per second imaging member 15 speed and a toning nip 6 width of about 0.375 inches, each point on the imaging member 15 will be exposed to approximately 5 north to south pole transitions during development in the toning nip 6, where 5 pole transitions is calculated as (257*0.375/17.49).

The developer is delivered to the toning shell 16 from a reservoir 7 in the lower area of the apparatus 10 using a feed roller 8.

As shown in FIG. 2, in one embodiment of the present invention, the magnetic core 14 comprises 900 gauss magnets arranged with N and S poles 18 alternating at regular intervals on magnetic core 14. The metering skive 28 is exterior to the magnetic brush 20. A takeoff skive 26 is located in a low field region of the magnetic brush 20. This embodiment can be used for both centric centered cores and ec-centric cores. The ec-centric core is especially useful for generating an electrostatic image on an imaging member 15, by moving the imaging member 15 in a process direction through an image development area defined between the toning shell 16 and the imaging member 15, rotating the toning shell 16 adjacent to the imaging member 15, in a co-current direction, such that the portion of toning shell 16 adjacent to the image development area moves in the process direction, applying developer comprising generally spherical toner to the toning shell 16 upstream of the image development area, wherein the rotation of the toning shell 16 brings the developer past the metering skive 28 and into a developing relationship with the electrostatic image in the image development area, and generating a varying magnetic field within the toning shell 16, wherein the varying magnetic field generates pole transitions in the image development area, wherein a rotation direction of the varying magnetic field in the image development area is opposite in sense to the direction of rotation of the toning shell 16 and the rotation direction of the magnetic core 14 is co-current with the rotation direction of the toning shell 16 and the motion of imaging member 15 in the image development area.

Mixers 4 in the reservoir 7 agitate to produce friction between components of the developer so that the magnetic carrier particles and the toner particles develop opposite charges in a triboelectric process, and the toner is mixed with the magnetic carrier particles. The motions of the imaging member 15, the toning shell 16, and the magnetic core 14 bring toner into a development relationship with the electrostatic image on the imaging member 15, and create an image development area within the toning nip 6. Marking particles from the developer applied to the electrostatic image in the image development area generate a transferable electrographic image on the imaging member 15 and the developer, depleted of toner particles used to develop the image on the imaging member 15, is removed from the toning shell 16 and returned to the reservoir 7.

A voltage source 30 is provided for placing a dc bias on the toning shell 16. Biasing the toning shell 16 relative to ground creates an electric field that attracts the toner particles to the toning shell 16 or to the imaging member 15. The electric field is at a maximum strength where the toning shell 16 is adjacent and closest to the imaging member 15. For example a bias voltage of −600 volts dc may be applied to the toning shell 16 in a printing process where the initial imaging member voltage is at −750 volts dc, and the voltage of exposed portions of the electrostatic image on imaging member is −150 volts dc.

Figure 3:
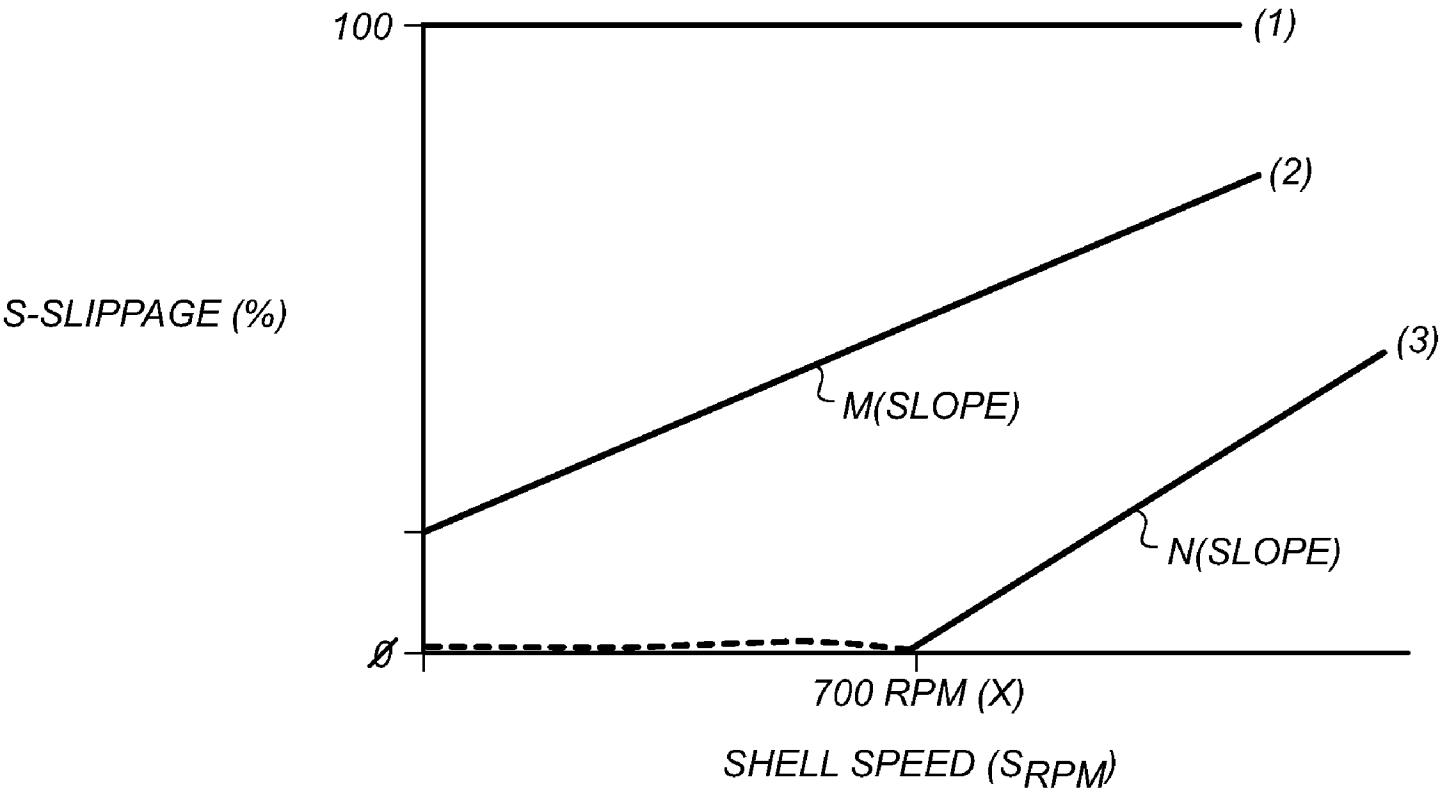
FIG. 3 is a schematic view of an expected slippage of developer on a toning shell according to the present invention.

In an embodiment of the invention, the imaging member 15 is rotated to produce an imaging member 15 velocity in a process direction, and the toning shell is rotated to produce a toning shell 16 surface velocity adjacent to the imaging member. Rotating the toning shell 16 co-currently produces a toning shell velocity that is co-directional with the imaging member 15 velocity in the toning nip 6. The rotation brings toner applied to the toning shell 16 into a developing relationship with the imaging member 15 in the toning nip 6. FIG. 3 shows the behavior of developer in an embodiment of this invention where an average developer bulk velocity (ADBV), defined as shown below, is varied in proportion a photoconductor speed. In a preferred embodiment.

$$ADBV=(1-s)*[\pi*D*(S_{rpm}/60)-\gamma*(2h*(N/2)*((C_{rpm}-S_{rpm})/60)) \quad \text{(Equation 1)}$$

is approximately equal to a photoconductor velocity;

where s is a fraction of slippage shown in FIG. 3, and γ is a fraction of excess free volume in a toning nip, D is a diameter of a toning shell, h is a height of carrier chains, N is a number of north and south magnetic poles, $C_{rpm}$ is a rotational speed of the magnetic core in rotations per minute, and $S_{rpm}$ is the rotational speed of a toning shell in rotations per minute, with all lengths in inches or other consistent units.

As illustrated in FIG. 3, the slippage of developer on the toning shell can vary between 0 and 100%, where 100% slippage occurs for perfectly spherical toner particles that are transported by a co-current shell and countercurrent rotating core. Since it is often advantageous to have toner particles that are not perfectly spherical and/or are not transported by a co-current shell and countercurrent rotating core, it is necessary to take into account any slippage that occurs with these shapes and changes in setpoints. As this graph shows, several different types of slippage are possible. For example, it is possible in one embodiment for approximately spherical toner particles to have slippage that varies with shell speed and that has a slope of M when transported by a co-current shell and co-current rotating core rotating at different speeds, or a co-current shell and co-current core rotating together, that is with no relative motion between the rotating shell and the rotating core, as shown in Line (2) of FIG. 3. In another embodiment, it is expected that the slippage of a non-spherical toner particle, for example, is near zero to point X at which the slippage increases at slope N since the slippage once again varies with shell speed when transported by a co-current shell and co-current rotating core, as shown in Line (3) of FIG. 3. This slope n as well as point X will vary depending on the exact shape of the particle as well as the relative speeds of the shell and core, including a co-current shell and core rotating together at the same rotational speed. These figures are useful for controlling the speed on a rotating or fixed magnetic device for transporting the toner particles and are either used for fixed values or stored in a table and used by a machine controller 19 (FIG. 2) to control various drivers or motors (22, 24) and optionally image quality such an image density controller can increase a shell speed and a core speed such that average developer bulk velocity (ADBV) is approximately equal to the photoconductor velocity and acceptable images are produced with relatively high toning efficiency. Ideal behavior is represented by no slippage at all. The invention can be used for the ideal case of no slippage, as well as the cases represented by Line (2) or Line (3) of FIG. 3. In particular, the invention can be used for either spherical or non-spherical toner for which minimal slippage occurs at low shell speed, but for which greater slippage occurs at greater shell speeds.

Alternatively the machine controller 19 is used to increase a shell speed and a core speed such that average developer bulk velocity (ADBV) is greater than the photoconductor velocity when the toner shape and printing requirements require it, such as when using toner particles with very high slippage. In one embodiment core speeds are such that there are over 246 pole flips per second and the machine controller 19 is optimized by tuning the average developer bulk velocity (ADBV) to be within a specific range from 50-100% of photoconductor velocity.

Figure 4:
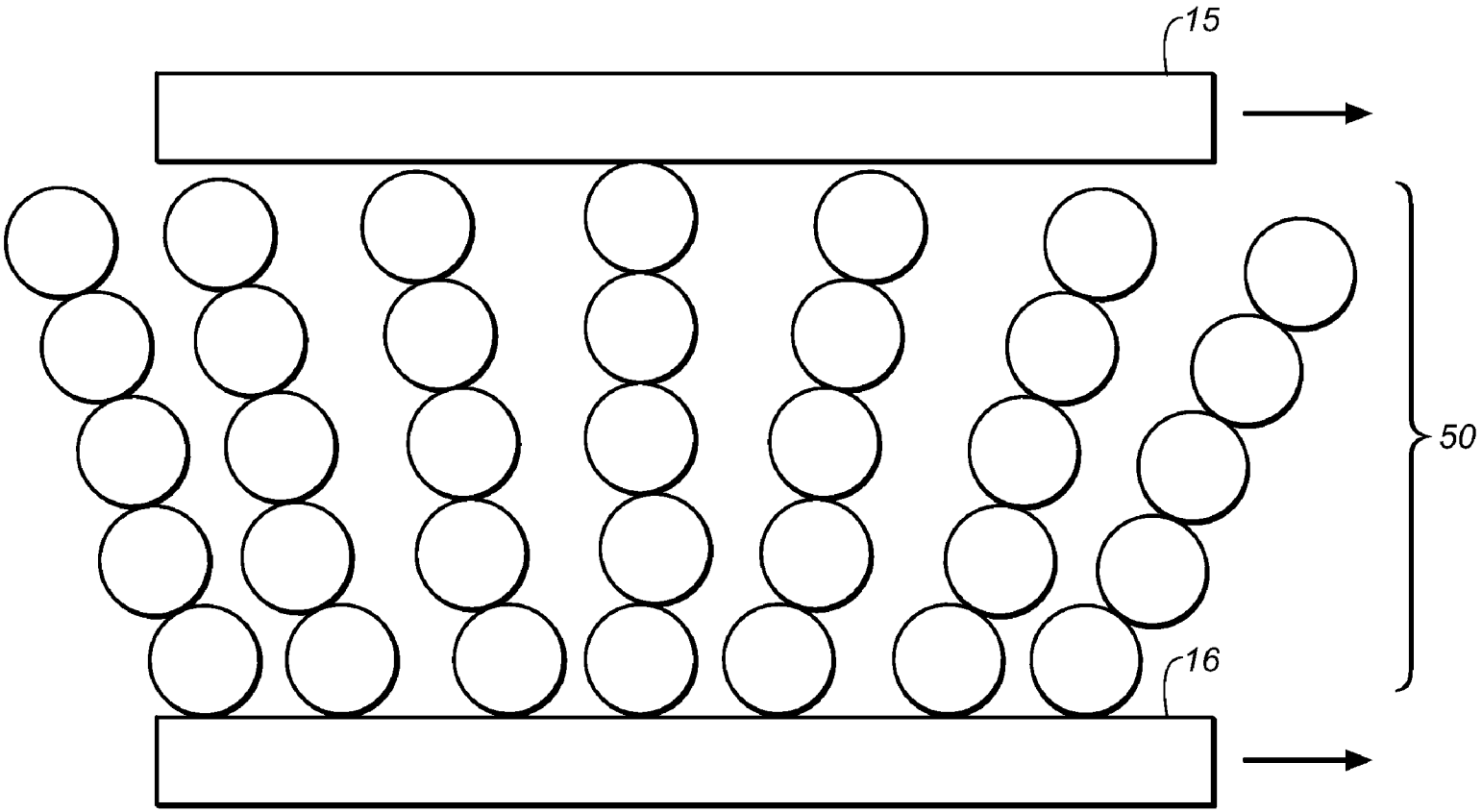
FIG. 4 is a side view schematically illustrating developer chains formed in an image developing area of an image developing apparatus according to the present invention.

As illustrated in FIG. 4, under the influence of the magnetic field created by the magnetic core 14, the magnetic carrier particles and the toner particles are arranged as chains of carrier particles 50 on the surface of the toning shell 16. The carrier chains 50 collectively form a nap on the surface of the toning shell 16. In FIG. 4, only carrier particles are shown. Toner particles are not shown. As the magnetic core 14 rotates, the magnetic field generated by the magnetic core 14 rotates from perpendicular to the toning shell 16 to parallel to the toning shell 16. The chains of magnetic carrier particles 50 collapse onto the surface of the toning shell 16 when the magnetic field is parallel to the surface of the toning shell 16, and rotate to be perpendicular to the toning shell 16 when the magnetic field is again perpendicular to the surface of the toning shell 16, the chains of carrier particles 50 rotate towards the perpendicular again. The flipping of the chains of carrier particles 50 imparts energy to free the toner from the developer to interact with the electrostatic field 9 on the imaging member 15.

Each flip, is accompanied by a circumferential step by each particle in the chains of carrier particles 50 in a direction opposite the movement of the magnetic core. As shown in FIG. 4, the toning shell 16 rotates co-currently with the imaging member 15 so that the motion of the toning shell 16 and the imaging member 15 within the toning nip 6 are co-directional. When the magnetic core 14 rotates in a counter-current direction opposite the co-current rotation of the toning shell 16, the chains of carrier particles 50 walk in the direction of the toning shell 16 and the imaging member 15.

On the other hand, when the toning shell 16 and the magnetic core 14 each rotate in the co-current direction, the chains 50 walk in the opposite direction from the direction of travel of the imaging member 15.

Each pole transition of the magnetic core 14 from a N pole to S pole produces 180 degrees (or π radians) of rotation of the magnetic field at a local point on the toning shell 16.

Rapid pole transitions generated by the magnetic core 14 create an energetic and vigorous movement of developer as the developer moves through the development zone. This vigorous action constantly provides energy for separating toner from the carrier chains to facilitate the application of fresh toner particles to the toning shell 16 and the imaging member 15.

The free ends of the magnetic carrier chains (i.e. the ends of the carrier chains away from the toning shell 16) travel in arcs in response to the rotation of the magnetic field of the magnetic core 14. In free space, or for a low friction toning shell 16, the preferred rotation mode is for the carrier chains of carrier particles 50 to flip or pivot around the center of the chain rather than about the non-free end of the toner chain.

The non-free end of the carrier chain is adjacent the toning shell 16, where the attraction of the magnetic field of the magnetic core 14 is greatest. For a given chain length and a given angular rotation speed for the chain, rotation about the center of a carrier chain involves a rotational energy that is one-quarter of the rotational energy for a chain flipping around an end of a carrier chain. Rotation about the center of the carrier chain has lower energy than rotation about the end of the carrier chain. If there is low friction between the carrier chain and the toning shell 16, slippage can occur.

Friction between the toning shell 16 and the developer particles is functionally related to characteristics of the developer particles and the toning shell surface. Toner particles may be generally spherical shaped, or may have non-spherical shapes. Non-spherical toner particles include raisin-shaped toner particles. A low friction combination may be produced with a smooth toning shell and spherical toning particles. Toning shells may be treated to provide a roughened surface, however the roughening steps add complexity to the manufacturing of toning shells which in turn adds to the cost of manufacturing a printing apparatus.

During developing of an electrographic image, developer is delivered to the toning shell 16 upstream of the toning nip 6. Ideally, the developer is distributed in a uniform layer on the toning shell 16 so that a high quality toner image results from development of the electrostatic latent image. The direction of rotation of the magnetic field influences the production of a uniform layer of developer by affecting the behavior of the magnetic carrier particles at the metering skive 28. In a preferred embodiment, the imaging member 15 and the toning shell 16 and the magnetic core 14 rotate co-currently.

Figure 5B:
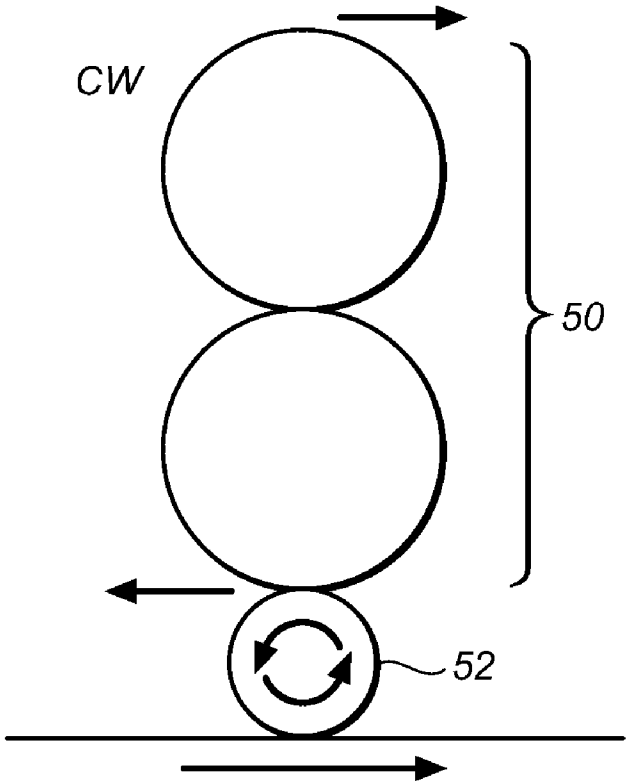
FIGS. 5A and 5B are views schematically illustrating motion of developer chains on a toning shell.
Figure 5A:
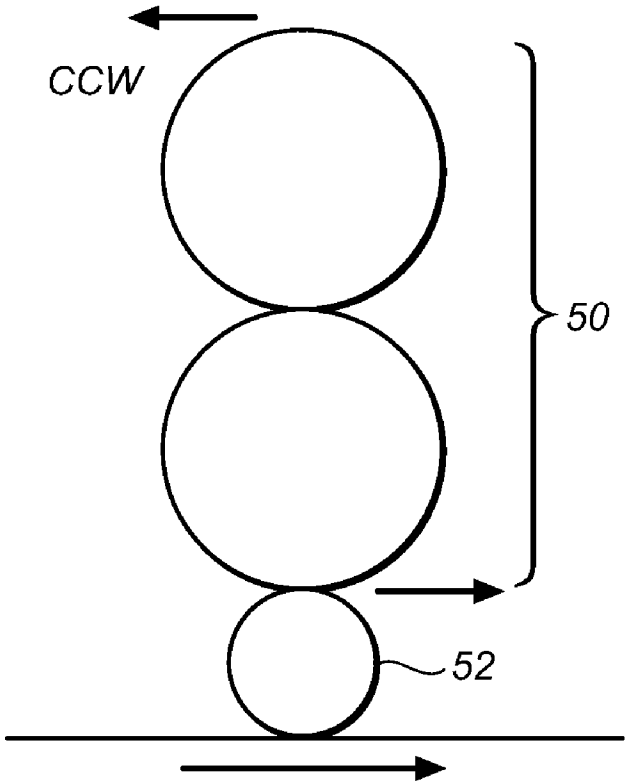

Using a spherically shaped toner particle with a toning shell 16 having a smooth surface can result in slipping of the carrier chains on the toning shell 16 when delivering the developer particles to the toning nip 6. The toning shell 16 is rotated in a co-current direction to allow approximate matching of the developer velocity to the imaging member velocity. In FIGS. 5A and 5B, co-current motion of the toning shell 16 corresponds to motion from left to right. As shown in FIG. 5B, if the magnetic core rotation is counter-current, the rotation of the carrier chains 50 will be clockwise (CW). If the carrier chain slips with respect to toning shell 16, it will rotate about its center of mass, and the end of the chain adjacent the toning shell 16 will move from right to left. Consequently, a spherical toner particle 52 can rotate and allow slippage between the carrier chain 50 and the toning shell 16 because the directions of motion of the end of the carrier chain and the direction of motion of the surface of the toning shell 16 are in opposite directions. As shown in FIG. 5A, if the magnetic core rotation is co-current, the rotation of the carrier chain 50 will be counterclockwise (CCW). If the carrier chain 50 slips, it will rotate about its center of mass, and the end of the chain adjacent the toning shell 16 will move from left to right. Consequently, a spherical toner particle 52 will not allow slippage between the carrier chain 50 and the toning shell 16 because the directions of motion of the end of the carrier chain 50 and the surface of the toning shell 16 are in the same direction, making rotation of the toner particle 52 in FIG. 5A unlikely. Therefore, co-directional motion of the toning shell 16 and imaging member 15 with co-current motion of the magnetic core 14 minimizes the build up of toner in the rollback zone and facilitates an even application of toner to the toning shell.

Further, as described in U.S. Pat. No. 6,728,503 issued to Stelter, Guth, Mutze, and Eck, the contents of which are fully incorporated by references as if set forth herein, effective developing of electrostatic images occurs when the average developer bulk velocity is within preferred ranges relative to image member velocity, and preferably the average developer bulk velocity is substantially equal to the image member velocity. By using relatively high, co-current magnetic core speeds in combination with relatively high co-current shell rotation speeds, it is possible to match developer velocity to process speed (imaging member velocity) while achieving at least 5 magnetic pole flips in a narrow development nip.

For example an experiment was conducted using a two component developer including 4 μm and 6 μm, cyan spherical marking particles. A 14 pole feed roller using 900 gauss magnets was used with a metering skive. The toning shell had a nominal diameter of 2 inches. The metering skive was set to a gap of 0.035 inches to the toning shell. The stripping skive was set to a gap of approximately 0.005 inches to the toning shell.

When applying a magnetic core and toning shell rotation of 800 revolutions per minute (RPM) counterclockwise (counter-current) and 82 RPM clockwise (co-current), the developer flowed unevenly unto the toning skive and dumped out of the developing station.

On the other hand, by rotating the magnetic core and the toning shell in co-current directions, set points under which the developer flows smoothly onto the toning shell to produce high quality prints can be obtained.

Figure 6:
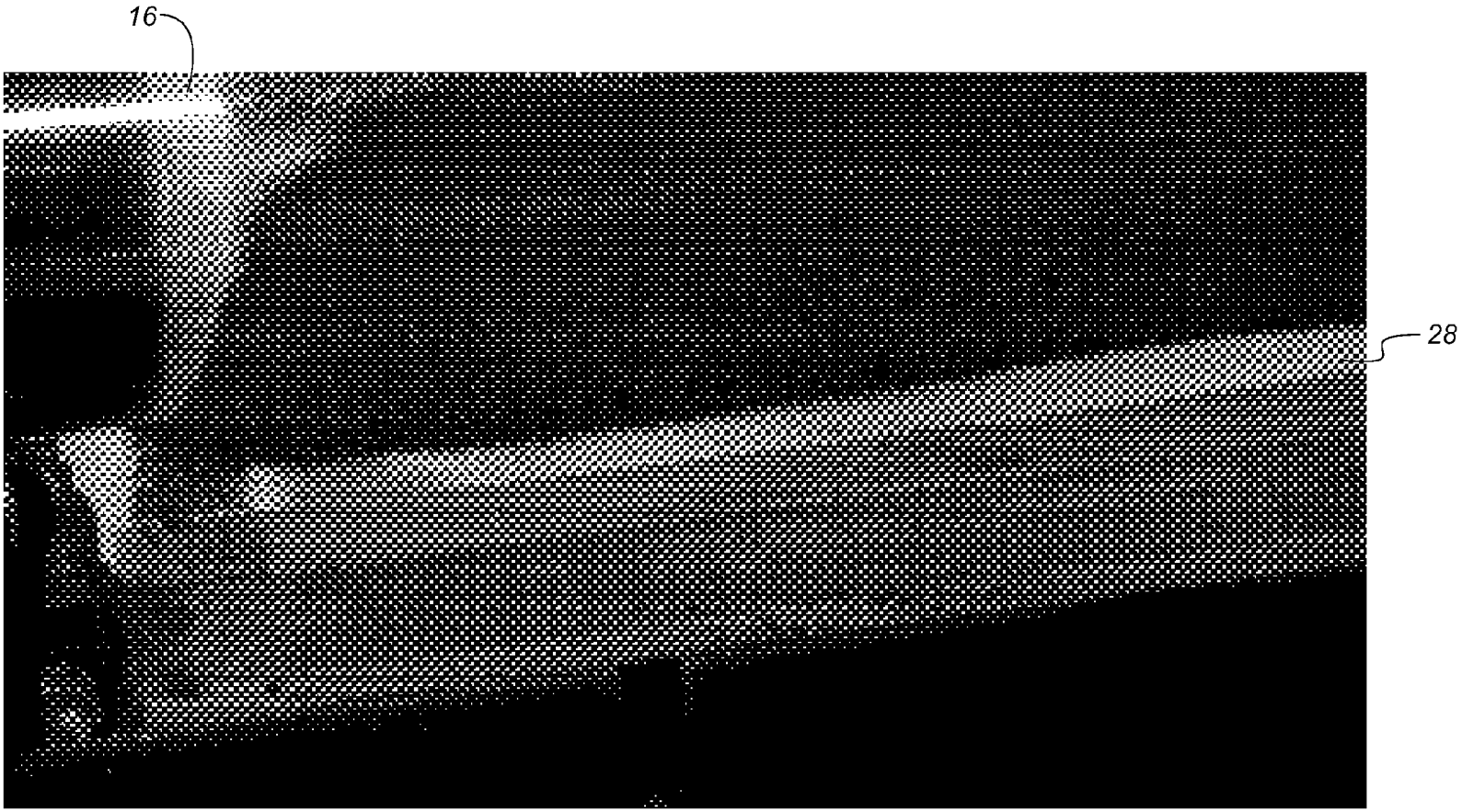
FIG. 6 (PRIOR ART)
FIG. 6 is view of toner applied to a toning shell in a conventional developing method.
Figure 7:
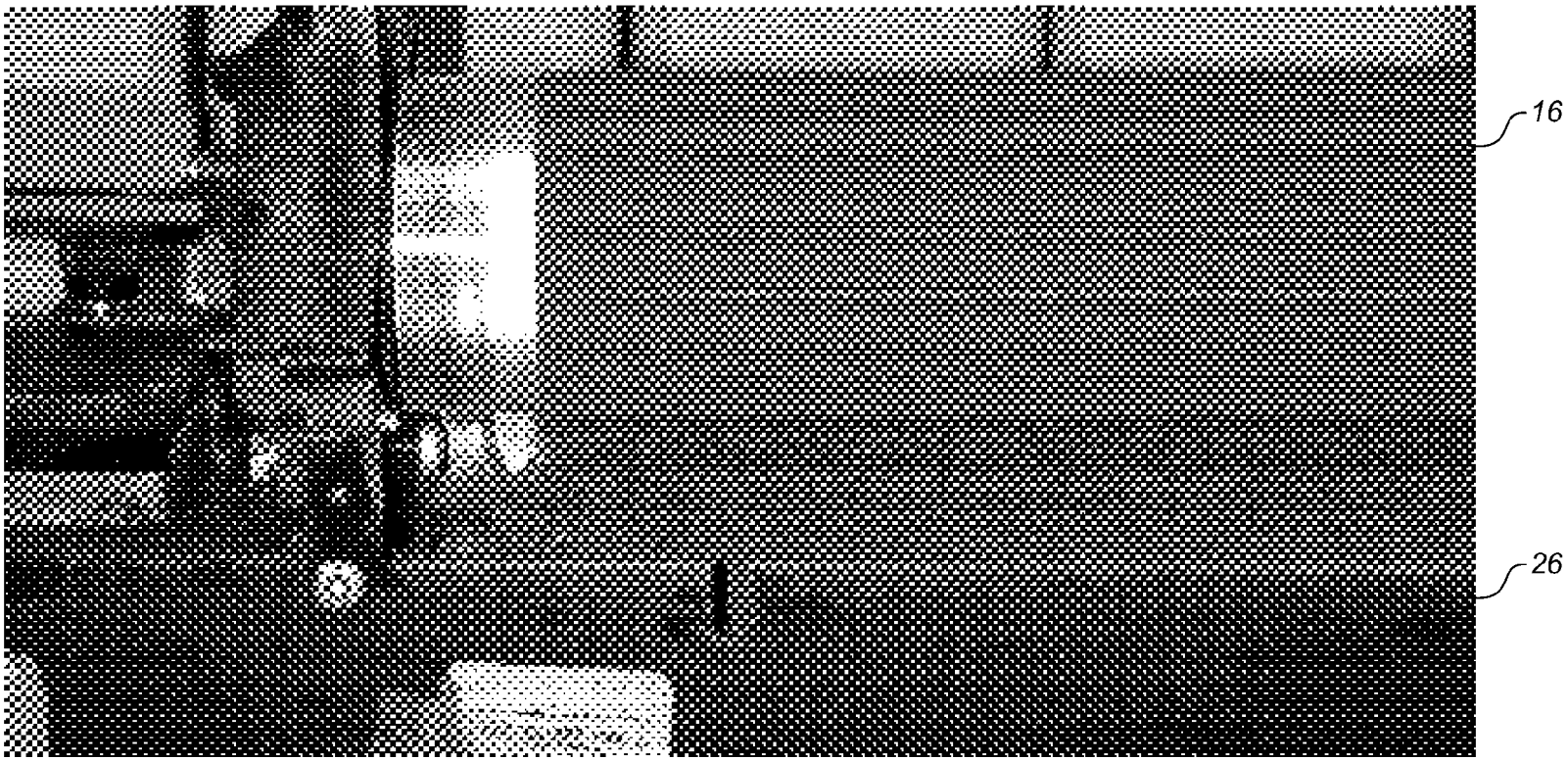
FIG. 7 is view of toner applied to a toning shell in a method according to the present invention.

For example, using the printing apparatus and toner described above, applying a magnetic core and toning shell rotation of 1000 revolutions per minute (RPM) clockwise (co-current) and 220 RPM clockwise (co-current), the developer using the generally spherical toner flowed evenly onto the toning shell and skived evenly at the metering skive 28 and the take off skive 26. FIG. 7 shows a result of applying a generally spherical toner using the co-current rotating magnetic field, where even application of the toner to the toning shell is achieved, while FIG. 6 shows a result of applying the generally spherical toner using a convention counter-current magnetic core rotation.

FIG. 5A represents a carrier chain 50 with a generally spherical toner particle on the surface of the toning shell 16 in a developing process in which the magnetic core 16 rotates in the co-current direction of the preferred embodiment. FIG. 5B represents a carrier chain 50 with a generally spherical toner particle in a developing process in which the magnetic core 16 rotates in a typical counter-current direction. As shown in the FIG. 5A, the rotation of the magnetic field produces a counterclockwise rotation of the carrier chain. Under these conditions, the toner particle at the surface of the toning shell 16 cannot act as a small ball bearing, and slippage of the developer nap on the toning shell 16 is reduced, particularly at the metering skive 28, toning nip 6, and take off skive 26, where external forces are applied to the developer. However, some slippage may occur. This is taken in account by variable s, which represents the fraction of developer that slips on the toning shell 16, as used in Equation 1, which gives the average developer bulk velocity.

By using co-current rotation of the toning shell 16 and the magnetic core 14 as in the present invention, as illustrated in FIG. 5A, even with some developer slippage, a smooth shell could be used in combination with generally spherical toner particles to produce high quality developed images.

Table 1 below provides experimental data obtained for a 110 PPM (pages per minute) process running at approximately 18.56 inches per second employing generally spherical toner and a co-current magnetic core rotation. The metering skive was set to 0.035 inches, the take off skive was set to 0.005 inches, and the developer contained generally spherical toner. Examples of such toner can be found in the commonly assigned application U.S. Ser. No. 12/342,138 entitled: METHOD OF PREPARING TONER HAVING CONTROLLED MORPHOLOGY, filed on Dec. 23, 2008. In a magnetic brush development system, development efficiency in percent, as defined in U.S. Pat. No. 6,723,481, is the potential difference between the photoreceptor in developed image areas before and after development divided by the potential difference between the photoreceptor and the brush prior to development times 100. For example, in a discharged area development configuration, if the photoreceptor film voltage is −50 volts and the magnetic brush is −450 volts, the potential difference is 400 volts prior to development. If, during development by negatively-charged toner, the film voltage is increased by 200 volts to −250 volts in image areas by the deposition of negatively charged toner particles, the development efficiency is (200 volts divided by 400 volts) times 100, which gives an efficiency of development of 50 percent.

TABLE 1

| Magnetic Core RPM | Shell RPM | Transport RPM | Development Efficiency | Developer flow rate (g/in sec) |
|---|---|---|---|---|
| 700 | 170 | 50 | 29.0 | 2.56 |
| 1000 | 243 | 50 | 33.7 | 2.32 |
| 1000 | 243 | 100 | 44.8 | 3.92 |
| 1300 | 316 | 150 | 44.8 | 4.14 |
| 1860 | 452 | 150 | 46.25 | 3.76 |

Table 2 below provides experimental data obtained for a 110 PPM process employing raisin-shaped toner and a co-current magnetic core rotation, except for the last two lines, for which counter-current magnetic core rotation was used. Countercurrent core rotation relative to shell rotation is indicated by a minus sign. The metering skive was set to 0.046 inches to obtain comparable developer flow rates at magnetic core speed of 700 RPM.

TABLE 2

| Magnetic Core RPM | Shell RPM | Transport RPM | Development Efficiency | Developer flow rate (g/in sec) |
|---|---|---|---|---|
| 700 | 170 | 50 | 22.9 | 2.34 |
| 1000 | 243 | 50 | 28.1 | 1.7 |
| 1000 | 243 | 100 | 28.9 | 1.88 |
| 1300 | 316 | 150 | 32.1 | 2.08 |
| 1860 | 452 | 150 | 30.4 | 3.76 |
| −800 | 82 | 98 | 30.1 | 1.94 |
| −1257 | 129 | 154 | 35.6 | 4.08 |

The last two lines of Table 2 represent setpoints used in commercial printers running at 70 PPM and proportional speedup of those setpoints.

The data in Table 1 for spherical toner and the corresponding data in Table 2 for raisin toner show that spherical toner can be developed with greater toning efficiency than raisin toner using co-current core rotation, despite not being able to be fed past the metering skive or developed at all with counter-current core rotation. From Tables 1 and 2, development efficiency for spherical toner is greater than development efficiency for raisin toner at the same conditions. Development efficiency for both types of toner with co-current core rotation generally increases with core speed and with developer flow rate, which are related. Assuming no slippage for raisin toner at the lowest shell speeds, for reasonable assumptions of 50% excess free volume fraction and 0.050 inch developer chain length, the average developer bulk velocity is calculated to be approximately 14.7 inches per second using Equation 1. As shell speed increases above 170 RPM, for acceptable images made at approximately the same average bulk developer velocity, approximately 30% slippage apparently occurs. At 452 RPM, approximately 60% slippage occurs. The slippage follows the behavior of Line 3 in FIG. 3. The spherical toner has approximately the same apparent slippage behavior as the raisin toner.

Figure 8:
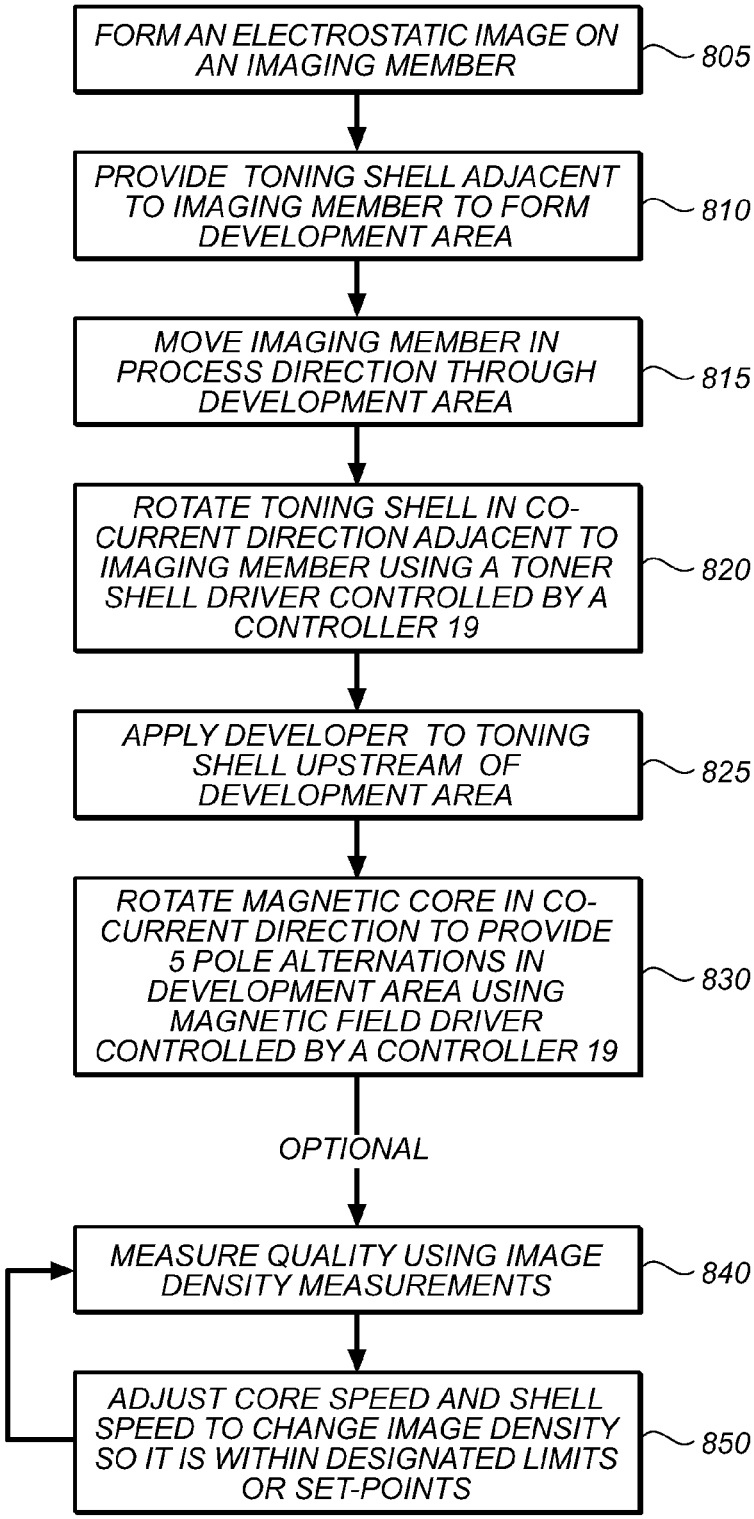
FIG. 8 is a flowchart illustrating a process for developing an electrographic image according to the present invention.

FIG. 8 illustrates a process for developing an electrographic image. The process can be carried out using the apparatus illustrated in FIG. 1. In step 805, an electrostatic image is formed on an imaging member. The electrostatic image may be formed by applying a uniform potential to an imaging member having and then performing an image wise exposure to selective discharge portions of the uniform potential. At step 810, a toning shell is provided adjacent to the imaging member to form a development area therebetween. The imaging member is then moved in a direction through the development area with an imaging member velocity (step 815).

At steps 820, 825, and 830, the toning shell is rotated in a co-current direction such that the portion of the toning shell adjacent to the imaging member moves in the same direction as the imaging member. Toner is applied to the toning shell upstream of the development area so that toning shell rotation brings the developer into a development relationship with the electrostatic image. A magnetic field is generated having a direction of rotation opposite in sense to the direction of rotation of the toning shell by rotating the magnetic core co-current with the toning shell, and with a rotation speed sufficient to generate an effective number of magnetic pole transitions (e.g. N- to S or S to N alternations) on each portion of the electrostatic image during passage of the electrostatic image through the development area. In an embodiment of the invention, the average developer bulk velocity through the development area is substantially the same as the velocity of the imaging member. A process controller can be used to change toning core and magnetic core rotational speeds to obtain acceptable image quality as represented by steps 840 and 850.

The invention has been described in detail with particular reference to certain preferred embodiments thereof, but it will be understood that variations and modifications can be effected within the spirit and scope of the invention.

PARTS LIST

4 Developer mixing augers
6 Toning nip
7 Toner reservoir
8 Toner feed roller
10 Electrographic printing apparatus
14 Magnetic core
15 Electrographic imaging member
16 Toning shell
18 Magnetic core poles
19 Controller
20 Magnetic brush
22 Toning shell driver motor
24 Magnetic core driver motor
26 Take off skive
28 Feed roller skive
30 Toning shell voltage source
50 Carrier particles
52 Toner particle

What is claimed is:

1. A method for forming an electrographic image, comprising:

generating an electrostatic image on an imaging member;

moving the imaging member in a process direction through an image development area defined between a toning shell and the imaging member;

rotating the toning shell adjacent to the imaging member, in a co-current direction, such that the portion of the toning shell adjacent to the image development area moves in the process direction;

applying developer comprising generally spherical toner having average developer bulk velocity (ADBV) upstream of the image development area, wherein the rotation of the toning shell brings the developer into a developing relationship with the electrostatic image in the image development area and the average developer bulk velocity (ADBV) is in the same direction and proportional to the imaging member velocity; and generating a varying magnetic field within the toning shell, wherein the varying magnetic field generates pole transitions in the image development area, and wherein a rotation direction of the varying magnetic field in the image development area is opposite in sense to the rotational direction of the toning shell.

2. The method according to claim 1, wherein a velocity of the imaging member through the image development area is substantially the same as an average developer bulk velocity (ADBV) of developer through the image development area.

3. The method according to claim 1, wherein the developer includes magnetic carrier particles and generally spherical toner particles.

4. The method according to claim 1, wherein the average developer bulk velocity (ADBV) is defined as:

$$ADBV=(1-s)*[\pi*D*(S_{rpm}/60)-\gamma*(2h*(N/2)*((C_{rpm}-S_{rpm})/60;$$

where

S is a fraction of slippage and γ is a fraction of excess free volume in a toning nip, D is the diameter of the toning shell; h=is height of carrier chains, N=# of north and south magnetic poles, $C_{rpm}$≅rotation speed of magnetic core (rpm)

$S_{rpm}$≅rotation speed of toning shell (rpm).

5. The method according to claim 4, further comprising a machine controller to increase a toning shell speed and a magnetic core speed such that average developer bulk velocity (ADBV) is approximately equal to the imaging member velocity.

6. The method according to claim 4, further comprising a machine controller to increase a toning shell speed and a magnetic core speed such that bulk density velocity (BDV) is greater than the an imaging member velocity 50 to 100% of photoconductor velocity.

7. The method according to claim 4, further comprising a machine controller to control the toning shell such that a toning shell surface speed is greater than an imaging member surface speed in the image development area.

8. The method according to claim 4, further comprises a machine controller to control image density by adjusting magnetic core and toning shell speed.

9. The method according to claim 1, wherein the varying magnetic field subjects each portion of the electrostatic image on the imaging member to at least 5 pole transitions during passage of the portion of the electrostatic image through the image development area.

10. The method according to claim 1, wherein generating the varying magnetic field within the toning shell includes rotating a magnetic core within the toning shell, the magnetic core including alternating pairs of magnetic poles.

11. An electrographic printing apparatus, comprising:

an imaging member;

a toning shell located adjacent the imaging member and defining an image development area therebetween through which developer is passed, the toning shell including a magnetic core having a plurality of magnetic poles arranged such that adjacent magnetic poles are of opposite polarity, the magnetic core located adjacent the toning shell;

a toning shell driver that moves the toning shell co-directionally with the imaging member; and a magnetic field driver that drives the magnetic core poles to produce a magnetic field rotating in opposite sense to the rotational direction of the toning shell and a reservoir that contains developer;

a feed roller including feed roller magnets that attract a magnetic carrier component of the developer from the reservoir, a rotating shell that applies developer comprising generally spherical toner having an average developer bulk velocity (ADBV).

12. The apparatus of claim 11, wherein the magnetic core is rotatable within the toning shell and the magnetic field driver rotates the magnetic core co-currently with the process direction of the imaging member.

13. The apparatus of claim 11, wherein the toning shell driver rotates the toning shell to move developer through the image development area with an average developer bulk velocity (ADBV) substantially the same as the imaging member velocity.

14. The apparatus of claim 11, wherein the developer includes magnetic carrier particles and generally spherical toner particles.

15. The apparatus of claim 11, wherein the average developer bulk density (ADBV) is defined as:

$$ADBV=(1-s)*[\pi*D*(S_{rpm}/60)-\gamma*(2h*(N/2)*((C_{rpm}-S_{rpm})/60;$$

where

S is a fraction of slippage and γ is a fraction of excess free volume in a toning nip, D is the diameter of the toning shell; h=is height of carrier chains, N=# of north and south magnetic poles, $C_{rpm}$≅rotation speed of magnetic core (rpm)

$S_{rpm}$≅rotation speed of toning shell (rpm).

16. The apparatus of claim 15, further comprising a machine controller to increase a toning shell speed and a magnetic core speed such that average developer bulk velocity (ADBV) is approximately equal to 50 to 100% of the imaging member velocity.

17. The apparatus of claim 16, further comprising a machine controller to increase a toning shell speed and a magnetic core speed such that average developer bulk velocity (ADBV) is greater than the imaging member velocity.

18. The apparatus of claim 11, wherein the magnetic field driver drives the magnetic core to subject each portion of an electrostatic image on the imaging member to at least 5 pole transitions during passage of the portion of the electrostatic image through the image development area.

19. The apparatus of claim 11, further comprises machine controller to control the toning shell such that a toning shell surface speed is greater than an imaging member surface speed in the image development area.

* * * * *